US005662859A

United States Patent [19]

Noda

[11] Patent Number: 5,662,859

[45] Date of Patent: Sep. 2, 1997

[54] CONSTANT MOLTEN METAL SURFACE LEVEL RETAINING FURNACE INTEGRALLY PROVIDED WITH MELTING UNIT

[75] Inventor: Sabrou Noda, Atsugi, Japan

[73] Assignee: Toshiba Kikai Kabushiki Kaisha, Tokyo-to, Japan

[21] Appl. No.: 639,276

[22] Filed: Apr. 25, 1996

[30] Foreign Application Priority Data

Apr. 26, 1995 [JP] Japan ..... 7-102636

[51] Int. Cl.[6] ..... C21D 11/00

[52] U.S. Cl. ..... 266/94; 266/239

[58] Field of Search ..... 266/239, 95, 94, 266/237; 222/595

[56] References Cited

U.S. PATENT DOCUMENTS

| | | | |
|---|---|---|---|
| 3,675,911 | 7/1972 | Kapun | 222/595 |
| 3,844,453 | 10/1974 | Eickelberg | 222/595 |
| 4,460,163 | 7/1984 | Hornung | 266/95 |
| 4,793,596 | 12/1988 | Kubota et al. | 266/239 |
| 5,477,907 | 12/1995 | Meyer et al. | 266/239 |

*Primary Examiner*—Scott Kastler

*Attorney, Agent, or Firm*—Cushman Darby & Cushman, IP Group of Pillsbury Madison & Sutro LLP

[57] ABSTRACT

A constant molten metal surface level retaining furnace is integrally provided with a melting unit which permits a space for equipment to be reduced to efficiently carry out transfer of molten metal. This furnace comprises, a heating unit (16) for heating a casting material to produce the molten metal, a furnace body having a molten metal treatment and storage chamber (18) for storing a molten metal after having undergone a predetermined molten metal treatment, and a molten metal retaining chamber (20) for storing the molten metal to be delivered to casting machine, which is partitioned from the molten metal treatment and storage chamber (18). A molten metal surface level control means is provided for conducting a control so that a molten metal surface within the molten metal retaining chamber (20) is maintained at a predetermined level. A molten metal force-feeding unit (40) is provided for supplying the molten metal in the molten metal retaining chamber (20) to the casting machine, wherein a transfer passage (24) which allows the molten metal treatment and storage chamber (18) and the molten metal retaining chamber (20) to communicate with each other is formed at the furnace body (10), and there are provided a tap (26) in molten metal for opening and closing the transfer passage (24) and an actuator (27) for driving the tap (26) in molten metal so that it is opened and closed.

7 Claims, 4 Drawing Sheets

CONSTANT MOLTEN METAL SURFACE LEVEL RETAINING FURNACE INTEGRALLY PROVIDED WITH MELTING UNIT

BACKGROUND OF THE INVENTION

1. Field of the Invention

This invention relates to a constant molten metal surface level retaining furnace integrally provided with a melting unit wherein the melting unit and a retaining unit for storing molten metal to be delivered to a casting machine such as a die casting machine while keeping the molten metal surface level constant are of an integral structure.

2. Description of the Prior Art

Hitherto, molten metal delivered to a casting machine such as die casting machine, etc. is stored within a holding furnace so that temperature of molten metal is kept constant, and is then delivered to the casting machine by an electromagnetic pump, etc.

As a folding furnace of this kind, a heat retaining furnace having constant molten metal surface level retaining function to keep the level of the molten metal surface constant, is used. As such heat retaining furnace, there is known a heat retaining furnace with a float system having a vertically moving float that is moved in dependency upon downward movement of the molten metal surface level (Japanese Patent Publication No. 30787/1990). Another heat retaining furnace of a gas application type is known in which pressurized gas is delivered into a pressurized chamber within the heat retaining furnace so that the molten metal surface level is kept constant (Japanese Patent Application Laid Open No. 127962/1990).

In general, in the case of die casting an alloy, in such molten metal heat retaining furnace, materials are collectively melted at a portion within a central melting furnace, and are delivered to heat retaining furnaces of respective die casting machines by means such as a molten metal distribution (delivery) vehicle, etc.

On the contrary, in high quality die casting using aluminum alloy, there are many instances where the central melting furnace cannot be utilized. Therefore, dedicated melting furnaces are provided for every die casting machines.

As a melting furnace of this kind, there are known a melting furnace of a inclination pouring type to pour molten metal into the heat retaining furnace in a state where the furnace is inclined, and a melting furnace to deliver molten metal into the heat retaining furnace by using a gutter. As described above, in the case where molten metal heat retaining furnaces and dedicated melting furnaces are respectively provided in die casting machine units, there are a problem of space for installation and a problem of degradation of the quality of the molten metal which takes place accompanied by low efficiency in the process where molten metal is transferred from the melting furnace to the heat retaining furnace. Particularly, in high quality die casting, the latter causes the problem seriously.

SUMMARY OF THE INVENTION

An object of this invention is to provide a constant molten metal surface level retaining furnace integrally provided with a melting unit which has solved the problems with the prior art, and allows the space for equipment to be reduced and efficiently carries out the transfer of molten metal.

To attain the above-described object, a constant molten metal surface level retaining furnace integrally provided with a melting unit of this invention includes, a heating unit for heating casting material to produce the molten metal; a furnace body having a molten metal treatment/storage chamber for storing the molten metal after having undergone a predetermined molten metal treatment and a metal retaining chamber for storing the molten metal to be delivered to a casting machine, which is partitioned from the molten metal treatment/storage chamber; a transfer passage means connecting the molten metal treatment and storage chamber and the molten metal retaining chamber in communication with each other; passage opening and closing means for opening and closing the transfer passage means; molten metal surface level control means for opening or closing the opening and closing means in dependency upon change of the quantity of the molten metal in the retaining chamber to conduct a control so as to allow the molten metal surface of the molten metal of the molten metal retaining chamber to be at constant level; and a molten metal force-feeding unit for delivering the molten metal within the molten metal retaining chamber to the casting machine.

In accordance with this invention, there is provided a structure in which the heating unit as melting means and the molten metal treatment and storage chamber and the molten metal retaining chamber are partitioned within the furnace body and a conventional melting furnace and a holding furnace are integrated. When molten metal within the molten metal retaining furnace is delivered to the casting machine by the molten metal force-feeding unit, the molten metal surface level control means becomes operative so that the molten metal surface level is kept constant. By operation of the passage opening and closing means, the molten metal within the molten metal treatment/storage chamber is transferred directly to the molten metal retaining chamber through the transfer passage provided within the furnace body. Also during such supply of molten metal into the molten metal retaining chamber, the molten metal surface level is kept constant by the molten metal level control means.

In accordance with a preferred embodiment of this invention, the passage opening and closing means includes a tap in molten metal attached at an entrance of the transfer passage at the molten metal treatment and storage chamber side, and an actuator connected to the tap in molten metal through a rod to open and close the tap in molten metal.

Moreover, the molten metal surface level control means may be composed of an immersion body vertically movably immersed in the molten metal within the molten metal retaining chamber, a vertical drive unit for vertically moving the immersion body, a molten metal surface detecting means for detecting whether or not the level if the surface of the molten metal within the retaining chamber is at a set level, immersion body position detecting means for detecting a vertical movement position of the immersion body, and a control unit for controlling the vertical drive unit on the basis of an output of the molten metal surface level detector so that the immersion body is sunk while keeping the molten metal surface level constant, and for controlling an actuator so that the tap in molten metal is opened when the immersion body sunk down to a predetermined position on the basis of a detection signal of the immersion body position detecting means.

In accordance with the molten metal surface level control means, when lowering of the molten metal surface within the molten metal retaining chamber is detected by the molten metal surface level detector, level of the molten metal is raised by discharge volume corresponding to lowering of the immersion body followed by the the vertical movement of the immersion body into the molten metal. Accordingly, the molten metal surface level is kept constant. In addition, when the immersion body is lowered to a predetermined position, this position is detected. As a result, the tap in the molten metal is opened, and molten metal is transferred from the molten metal treatment and storage chamber to the molten metal retaining chamber. Thus, efficient molten melt transfer while keeping molten metal surface at constant level is automatically carried out.

In accordance with other features, the molten metal surface level control means may be composed of a pressurized chamber partitioned as a closed space within the molten metal retaining chamber and means for supplying a pressurized gas into the pressurized chamber, a molten metal surface detector for detecting that the molten metal surface of molten metal within the molten metal retaining chamber is at set level, molten metal surface level detecting means for detecting a height position of the the metal surface in the pressurized chamber, and a control unit for controlling the actuator so that the tap in the molten metal is opened when the molten metal surface level of the pressurized chamber is lowered to a predetermined position.

When lowering of the molten metal surface of the molten metal retaining chamber is detected by the molten metal surface level detector, pressurized gas is delivered into the pressurized chamber so that the molten metal surface of the pressurized chamber is downwardly moved. As a result, the molten metal surface level of the molten metal retaining chamber is restored (returned). When the molten metal surface of the pressurized chamber is further lowered so that it is below a predetermined position, this is detected. Thus, the tap in the molten metal is opened, and molten metal is transferred from the molten metal treatment/storage chamber into the molten metal retaining chamber. Accordingly, efficient molten metal transfer is carried out.

As the molten metal force-feeding unit, electromagnetic pump is suitable. In place of this electromagnetic pump, however, such molten metal force-feeding unit may be composed of a pressurized chamber to which molten metal within the molten metal retaining chamber is introduced, a tap in the molten metal for opening or closing a passage which allows the pressurized chamber and the molten metal retaining chamber to communicate with each other, and an actuator for driving the tap in the molten metal so that it is opened or closed to press the molten metal surface of the pressurized chamber by pressurized gas to supply a constant quantity of molten metal into the casting machine.

Moreover, a movement unit may be provided within the furnace body so that the discharge portion of the molten metal force-feeding unit can be detachably connected to the casting machine.

In accordance with such configuration, the furnace body can be moved in addition to reduction of installation space of the apparatus by the structure in which the molten metal treatment and storage chamber and the molten metal retaining furnace are integrated. Accordingly, installation/mounting work is facilitated.

BRIEF DESCRIPTION OF THE DRAWINGS

Preferred embodiments of a constant molten metal surface retaining furnace according to this invention will now be described with reference to the attached drawings.

DETAILED DESCRIPTION OF THE PREFERRED EMBODIMENTS

Figure 1:
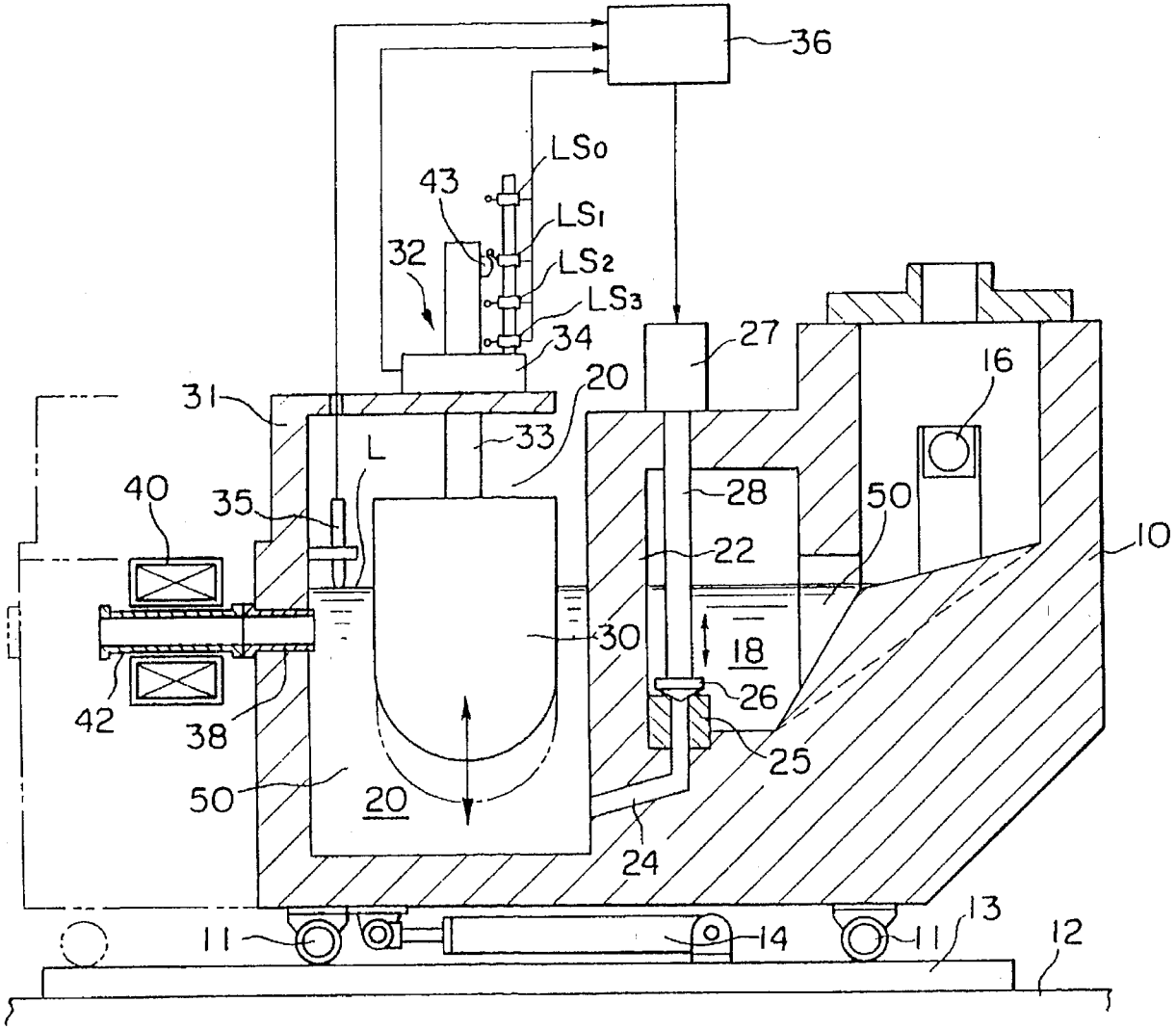
FIG. 1 is a cross sectional view showing the configuration of a first embodiment of this invention.

In FIG. 1, reference numeral 10 denotes a furnace body of a constant molten metal level retaining furnace integrally provided with a melting unit according to a first embodiment of this invention, and reference numeral 12 denotes a base.

In this embodiment, the furnace body 10 is supported by wheels 11 that are rotationally moved along rails 13 laid on the base 12, and connection of the furnace body 10 with a casting machine (not shown) is carried out by operation of a hydraulic cylinder 14 constituting a movement unit along with the wheels 11.

The furnace body 10 is a furnace of a unitary structure in which a molten metal treatment and storage chamber 18 and a molten metal retaining chamber 20 are partitioned with a partition wall 22, and a molten metal 50 obtained from a casting material after heating and melting by a melting burner 16 is stored within the molten metal treatment and storage chamber 18, within which treatment such as de-gassing or de-sediment, etc. is implemented thereto. At the partition wall 22 which forms a partition between the molten metal treatment and storage chamber 18 and the molten metal retaining chamber 20, a transfer passage 24 is provided which allows the molten metal treatment and storage chamber 18 and the molten metal retaining chamber 20 to communicate with each other. Within the molten metal retaining chamber 20, the molten metal 50 is stored while it is kept at a constant molten metal surface level L.

At the entrance of the transfer passage 24, a seat 25 is attached. A tap 26 in the molten metal can be seated on the seat 25. The tap 26 in the molten metal is connected to an actuator 27 for opening and closing through a rod 28, and the tap 26 in the molten metal is moved in upward and downward directions by operation of the actuator 27. Thus, the entrance of the transfer passage 24 is opened or closed.

On the other hand, within the molten metal retaining chamber 20, a float 30 as an immersion body is provided so that it can move vertically while being immersed in the molten metal 50. This float 30 is such that its surface is formed by a material of a property resistant to the molten metal, and the immersion volume is set to a value less than a maximum volume for drawing the molten metal out of the molten metal retaining chamber 20. The float 30 is supported in a manner immersed in the molten metal 50 directly from above the furnace by a vertical drive unit 32 attached through a bracket 31. This vertical drive unit 32 comprises a supporting rod 33 having a rack, a pinion engaged with the rack of the supporting rod 33, and a motor for driving the pinion.

Within the molten metal retaining chamber 20, a molten metal surface level detector 35 is provided. An adjustment is made such that the position of a tip end of the level detector 35 is in correspondence with a set level L of the molten metal surface. Moreover, the level detector 35 is connected to a control unit 36. This control unit 36 is operative to sink the float 30 so that the molten metal surface is kept at the set level L as described later, to control the motor of the previously described vertical drive unit 32, and to control the opening and closing operation of the tap 26 in the molten metal of the molten metal treatment and storage chamber 18 in dependency upon position of the float 30.

As means for detecting the position of the float 30, a plurality of limit switches LS0, LS1, LS2, LS3 are provided which are disposed at intervals in the vertical direction. Among those limit switches, the limit switch LS1 corresponds to the position of the float 30 when the molten metal 50 is fully stored within the molten metal retaining chamber 20, the limit switch LS2 corresponds to the position where the tap 26 in the molten metal is opened in order to supply the molten metal 50 from the molten metal treatment and storage chamber 18, and the limit switch LS3 corresponds to a lower limit position of the float In this example, the limit switch LS0 provided at the uppermost position is a switch for stopping the float 30 at the upper limit position.

On the other hand, at the supporting rod 33 vertically moving along with the float 30, a dog 43 is attached for acting on levers of the limit switches LS0, LS1, LS2, LS3 to allow them to be turned ON and OFF. ON/OFF signals of these limit switches LS0, LS1, LS2, LS3 are introduced into the control unit 36. Thus, the control unit 36 controls the actuator 27 so that when the limit switch LS1 is in an ON state, the tap 26 in the molten metal is closed, and when the limit switch LS2 is in an ON state, the tap 26 in the molten metal 50 is opened.

In this example, at the side wall portion of the furnace body 10 on the side of the molten metal retaining chamber 20, a pipe 38 connected to a suction port of an electromagnetic pump 40 is attached. A discharge pipe 42 of the electromagnetic pump 40 is detachably connected to the molten metal supply pipe of the casting machine (not shown). When the cylinder 14 is extended, the entirety of the furnace body 10 moves to the casting machine side along the rails 13, and the discharge pipe 42 is connected to the molten metal supply tube of the casting machine at the position indicated by double dotted lines in the figure.

The operation of this embodiment will now be described.

Initially, when molten metal 50 in the molten metal retaining chamber 20 begins to be supplied to the casting machine by the electromagnetic pump 40, the surface level of the molten metal 50 within the molten metal retaining chamber 20 is lowered from the set level L. At this time, since the molten metal 50 is caused to move down relative to the molten metal surface level detector 35, the control unit 36 detects lowering of the molten metal surface to control the motor of the vertical drive unit 32 so that the float 30 is sunk (moved downwardly). As a result, the quantity of molten metal expelled by the float 30 is increased as the float 30 gradually lowers, whereby the level of the molten metal surface is restored.

The molten metal surface is maintained at the predetermined set level L in this way. On the other hand, when the limit switch LS2 is turned ON at the time point when the float 30 is lowered to a predetermined position indicated by doule dotted lines in FIG. 1, the control unit 36 transmits, to the vertical drive unit 32, a command signal to return the float 30 to the initial position, and allows the actuator 27 to be operative to elevate the tap 26 in the molten metal. As a result, the entrance of the transfer passage 24 is opened so that molten metal of the treatment and storage chamber 18 is delivered to the molten metal retaining chamber 20 through the transfer passage Accordingly, for a time period during which the float is elevated so that it returns to the initial (original) position, molten metal 50 is supplied without allowing the molten metal surface to be lowered. When the float 30 returns to the initial position, the limit switch LSl is turned ON. Accordingly, the control unit 35 outputs a command signal to close the tap 26 in molten metal to the actuator 27. Thus, the tap 26 in molten metal is lowered so that it is seated on the seat 25. As a result, the transfer passage 24 is closed.

As described above, at the time point when the float 30 is lowered to a predetermined position, molten metal 50 is efficiently and automatically supplied directly from the molten metal treatment and storage chamber 18, and the level of the molten metal surface is kept constant for that time period. Accordingly, it is possible to stably supply molten metal 50 to the casting machine, and to prevent the degradation of quality of the molten metal accompanied by transfer of molten metal.

It is to be noted that, at the time of completion of the casting work, the float 30 is lowered to the lowermost limit position closer to the bottom. Thus, the remaining quantities of molten metal in the molten metal retaining chamber 20 and the molten metal treatment and storage chamber 18 are made to be as small as possible. The fact that the float 30 is located at this position is detected by turning ON of the limit switch LS3. Thus, this fact is displayed on a display device (indicator).

Figure 2:
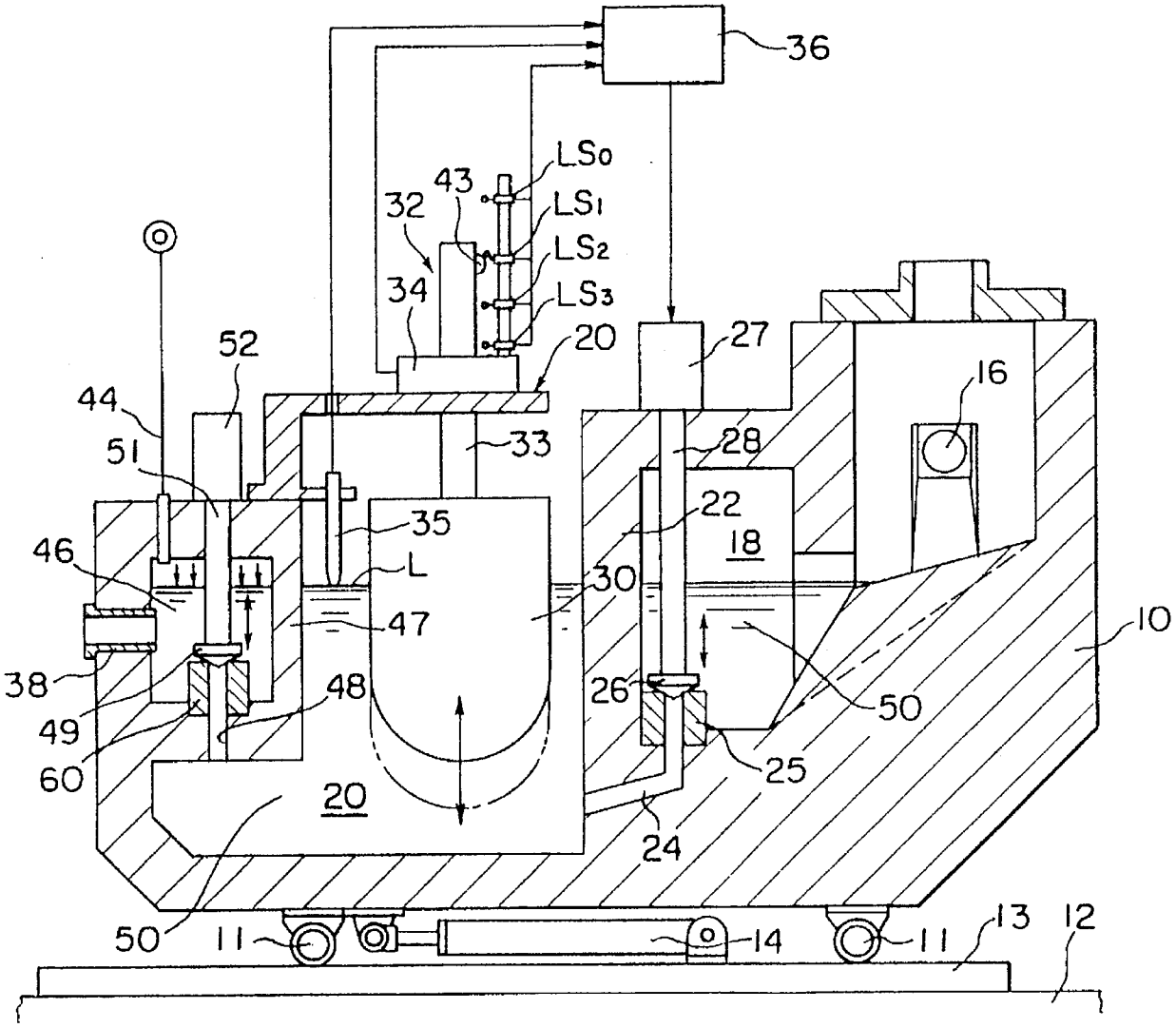
FIG. 2 is a cross sectional view showing the configuration of a second embodiment of this invention.

FIG. 2 shows a second embodiment of this invention. In this embodiment, in place of the electromagnetic pump 40 of the first embodiment of FIG. 1, a molten metal force-feeding unit is constituted by a pressurized chamber 46, wherein pressurized air is introduced into the pressurized chamber 46 so that molten metal is delivered to the casting machine.

In this embodiment, inert gas pressurized so as to have a predetermined pressure is supplied from a pressure gas supply piping 44 to the pressurized chamber 46. Moreover, at the bottom portion of a partition wall 47 which forms the pressurized chamber 46, a passage 48 is formed in a manner penetrating therethrough. Opening and closing operation of the passage 48 is carried out by causing a second tap 49 in molten metal to be seated on the seat 50, and to cause it to move away from the seat 50. The second tap 49 in molten metal is connected to the actuator 52 through a rod 51.

In the second embodiment constituted in this way, only when the molten metal 50 is supplied to the pressurized chamber 46 of the molten metal retaining chamber 20, the second tap 49 is elevated so that the passage 48 is opened. Until supply of the molten metal 50 into the pressurized chamber 46 is completed, the float 30 is sunk similarly to the case of the first embodiment so that the molten metal surface is kept at a set level L. Similarly to the case of the first embodiment, when the float 30 is lowered to a predetermined position indicated by double dotted lines, the limit switch LS2 is turned ON, and the tap 26 in the molten metal is opened. Thus, the molten metal 50 is supplied through the transfer passage 24 from the molten metal treatment and storage chamber 18.

Supply of the molten metal into the casting machine is carried out in a state where the second tap 49 in the molten metal is lowered so that the passage 48 is closed. When the second tap 49 in molten metal is closed, pressurized gas is introduced from the gas supply piping 44 into the pressurized chamber 46, and the surface of the molten metal of the pressurized chamber 46 is pressed by that pressure. Accordingly, the molten metal is delivered from the pipe 38 into the casting machine. A quantity of the molten metal to be supplied is controlled so that a predetermined quantity thereof is delivered to the casting machine by means of a timer or a sensor for detecting a change of level of the molten metal 50.

Figure 3:
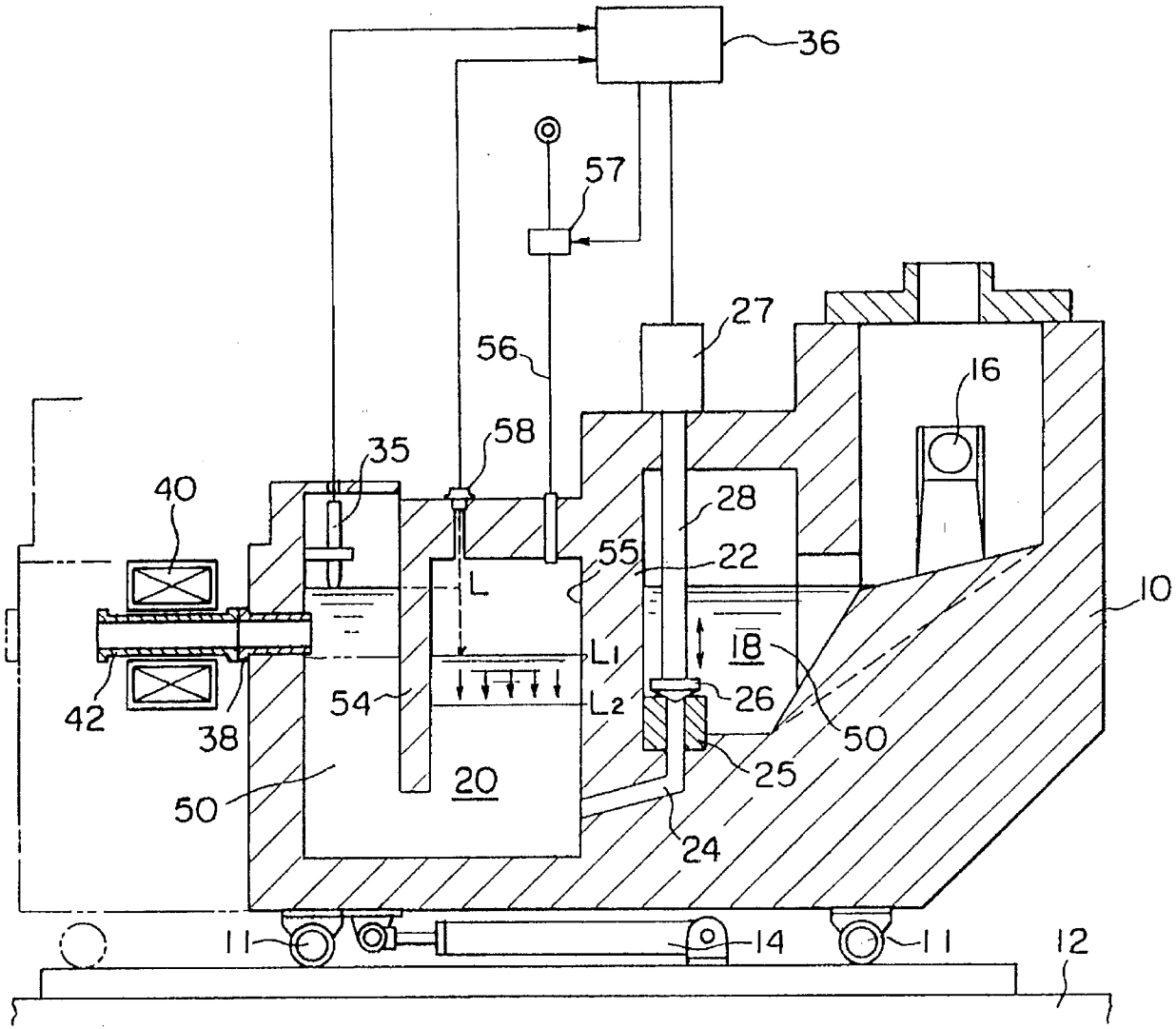
FIG. 3 is a cross sectional view showing the configuration of a third embodiment of this invention.

FIG. 3 shows a third embodiment. In this third embodiment, as means for keeping, at a set level L, the molten metal 50 which is lowered in level when the molten metal 50 is supplied into the casting machine by the electromagnetic pump 40, a pressurized chamber 55 is provided in place of the float 30 in the first embodiment of FIG. 1 to pressurize the molten metal within the pressurized chamber 55 by pressurized gas so that it is pushed down.

In the third embodiment, the pressurized chamber 55 is formed as a closed space by a partition wall 54 extending downwardly in a manner immersed into the molten metal 50. In the state where no pressurized gas is introduced, the molten metal surface is at the same level at the inside and the outside of the partition wall 54. Moreover, pressurized gas which is inert with respect to the molten metal is delivered through a control valve 57 and a supply piping 56 to the pressurized chamber 55. During the casting process, the surface of the molten metal 50 in the retaining chamber 20 is maintained at the set level L. When the electromagnetic pump 40 is operated so that molten metal 50 in the molten metal retaining chamber 20 begins to be supplied to the casting machine, the molten metal surface within the pressurized chamber 55 is further lowered. Thus, at the suction side of the electromagnetic pump 40, the molten metal surface level is maintained so that it is not lowered.

Moreover, in this embodiment, as means for detecting the position of the molten metal surface within the pressurized chamber 55 to take timing for opening the tap 26 in the molten metal 50, a non-contact type displacement sensor 58 is provided to which laser or ultra-sonic waves, etc. is applied. A detection signal of the displacement sensor 58 is supplied to the control unit 36. When the control unit 36 detects that the molten metal surface within the pressurized chamber 55 is lowered to the level of L2, it allows the actuator 27 to be operative to open the tap 26 in the molten metal 50. Accordingly, molten metal 50 in the molten metal treatment and storage chamber 18 is supplied to the molten metal retaining unit 20 through the passage 24. Thus, lowering of the molten metal at the suction side of the electromagnetic pump 40 is prevented, and transfer of molten metal is efficiently carried out. For a time period during which transfer of molten metal is carried out, pressure of pressurized gas is adjusted through the control value 57 by the control unit 36.

Figure 4:
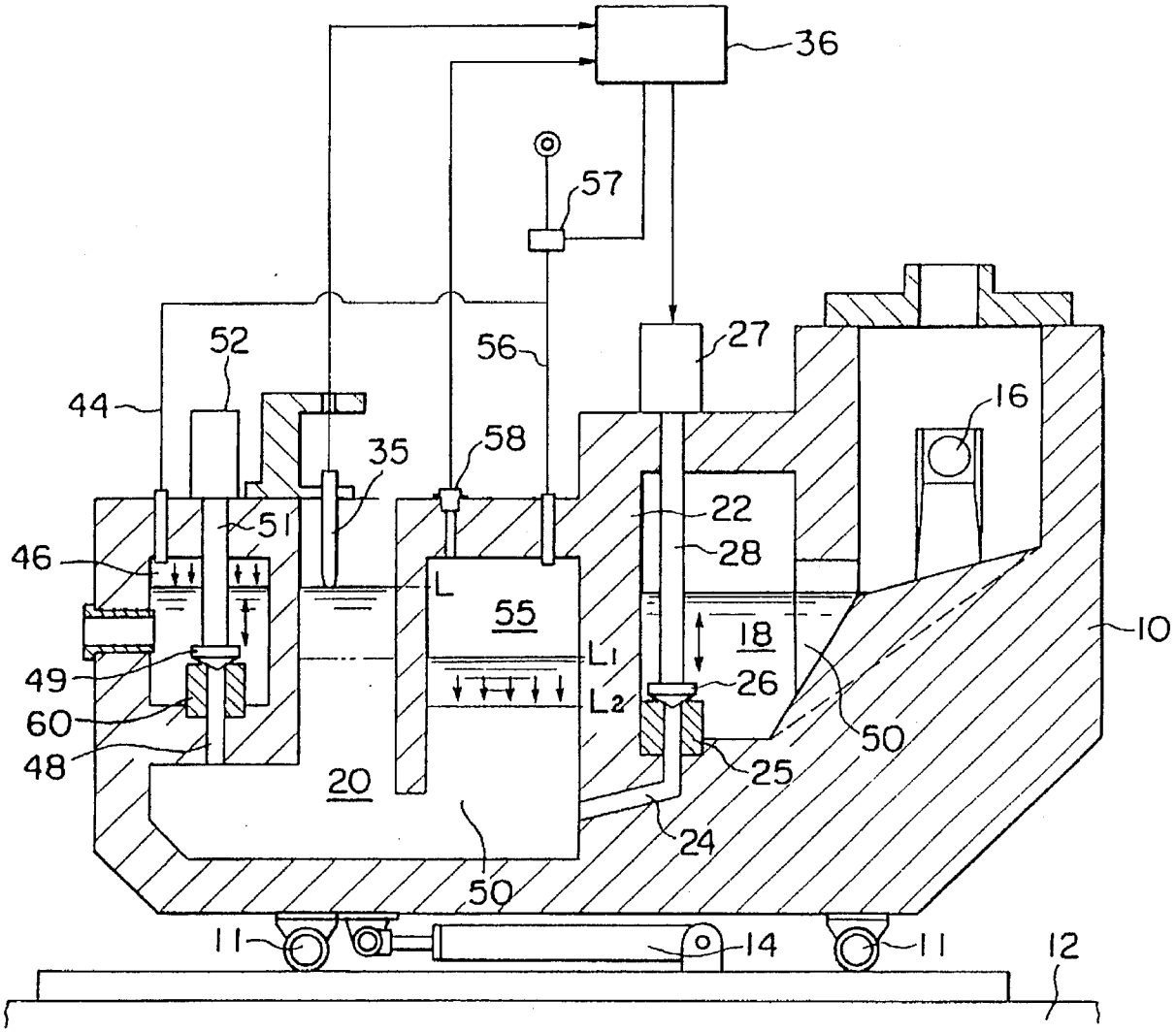
FIG. 4 is a cross sectional view showing the configuration of a fourth embodiment of this invention.

FIG. 4 shows an example of the configuration in which molten metal 50 is force-fed to the casting machine by the pressurized chamber 46 of the second embodiment in place of the electromagnetic pump 40 of the third embodiment. With respect to other components, the same reference numerals are respectively assigned to the same components as those of FIGS. 2 and 3, and their detailed explanation will be omitted.

In this fourth embodiment, supply of molten metal 50 into the casting machine is carried out in a state where the second tap 49 in molten metal closes the passage 48. Similarly to the second embodiment, pressurized gas is introduced from the supply piping 44 into the pressurized chamber 46, and pressure apply to the molten metal in the pressurized chamber 46 so that the molten metal is supplied from the pipe 38 into the casting machine.

On the other hand, for a time period during which the second tap 49 is opened to supply the molten metal 50 into the pressurized chamber 46, the surface of the molten metal 50 in the retaining chamber 20 is kept at a constant level by by pressurized gas similarly to the third embodiment. Further, when the molten metal surface within the pressurized chamber 55 is lowered down to the level of L2, the tap 26 in the molten metal 50 is opened. Thus, the molten metal 50 within the treatment and storage chamber 18 is supplied to the retaining chamber 20 through the passage 24.

While non-contact type displacement sensor can be used as means for detecting the position of the molten metal surface of the pressurized chamber 55 in this embodiment, such a configuration may be employed, in addition to the above, as to provide a float floating on the molten metal, to detect, by a photoelectric sensor, a light intercepting plate which undergoes displacement in dependency upon the position of that float to constitute detecting means similar to the limit switch of the embodiment of FIG. 1.

As is clear from the foregoing description, in accordance with this invention, the furnace body is of unitary structure provided with a molten metal treatment and storage chamber and a molten metal retaining chamber of the constant molten metal surface type, so that space required for equipment can be reduced to a great degree, and the molten metal can be transferred directly to the molten metal retaining chamber by opening and closing the tap in molten metal in dependency upon change of molten metal quantity. Accordingly, the degradation in quality of molten metal can be prevented. In addition, since the molten metal is transferred while the level of the surface of the molten metal in the retaining chamber is kept constant, molten metal can be efficiently and stably transferred.

What is claimed is:

1. A constant molten metal surface level retaining furnace integrally provided with a melting unit adapted for supplying a molten metal to a casting machine, the furnace comprising:

a heating unit for heating a casting material to produce the molten metal;

a furnace body having a molten metal treatment and storage chamber for storing the molten metal after having undergone molten metal treatment, and a molten metal retaining chamber for storing the molten metal to be delivered to the casting machine, which is partitioned from the molten metal treatment and storage chamber;

transfer passage means connecting the molten metal treatment and storage chamber and the molten metal retaining chamber in communication with each other;

passage opening and closing means for opening and closing the transfer passage means;

molten metal surface level control means for opening and closing the opening and closing means in dependency upon change of the quantity of the molten metal in the molten metal retaining furnace to control a surface of the molten metal in the molten metal retaining chamber to be maintained at a desired level; and molten metal force-feeding means for supplying the molten metal within the molten metal retaining chamber to the casting machine.

2. A constant molten metal surface level retaining furnace integrally provided with a melting unit set forth in claim 1, wherein the passage opening and closing means includes a tap in the molten metal attached at an entrance of the transfer passage at the side of the molten metal treatment and storage chamber, and an actuator connected to the tap in the molten metal through a rod and adapted for opening and closing the tap in the molten metal.

3. A constant molten metal surface level retaining furnace integrally provided with a melting unit as set forth in claim 2, wherein the molten metal surface level control means includes:

an immersion body immersed in the molten metal within the molten metal retaining chamber so that it is vertically moved;

vertical drive means for vertically moving the immersion body;

molten metal surface detecting means for detecting whether or not the molten metal surface of the molten metal within the molten metal retaining chamber is at a set level;

immerse body position detecting means for detecting a vertical movement position of the immersion body; and control means for controlling the vertical drive means on the basis of an output of the molten metal surface detecting means so that the immersion body is sunk while keeping the molten metal surface at the level, and controls the actuator so that the tap in molten metal is opened when the immersion body is lowered to a certain position, on the basis of a detection signal of the immersion body position detecting means.

4. A constant molten metal surface level retaining furnace integrally provided with a melting unit as set forth in claim 2, wherein the molten metal surface level control means includes:

a pressurized chamber partitioned as a closed space within the molten metal retaining chamber;

means for supplying pressurized gas into the pressurized chamber;

molten metal surface detecting means for detecting that the molten metal surface of the molten metal within the molten metal retaining chamber is at a set level;

molten metal surface level detecting means for detecting height position of the molten metal surface in the pressurized chamber; and control means for controlling the actuator so that the tap in the molten metal is opened when the molten metal surface level of the pressurized chamber is lowered to a certain position.

5. A constant molten metal surface level retaining furnace integrally provided with a melting unit as set forth in claim 3, wherein the molten metal force-feeding unit is comprised of an electromagnetic pump.

6. A constant molten metal surface level retaining furnace integrally provided with a melting unit as set forth in claim 3, wherein the molten metal force-feeding unit includes:

a pressurized chamber into which molten metal of the molten metal retaining chamber is introduced;

a tap in molten metal for opening and closing a passage which allows the pressurized chamber and the molten metal retaining chamber to communicate with each other; and an actuator for driving the tap in the molten metal so that it is opened or closed, thus to press the molten metal surface of the pressurized chamber by pressurized gas to supply a constant quantity of molten metal into the casting machine.

7. A constant molten metal surface level retaining furnace integrally provided with a melting unit as set forth in claim 1, further comprising;

drive means for moving the furnace body; and connection means for detachably connecting a discharge section of the molten metal force-feeding unit to the casting machine.

* * * * *